US008334418B2

(12) United States Patent
Osegovic et al.

(10) Patent No.: US 8,334,418 B2
(45) Date of Patent: Dec. 18, 2012

(54) ACCELERATED HYDRATE FORMATION AND DISSOCIATION

(75) Inventors: John P. Osegovic, St. Petersburg, FL (US); Brian Blake-Collins, St. Petersburg, FL (US); Ian M Slattery, St. Petersburg, FL (US); Michael D Max, St. Pete Beach, FL (US)

(73) Assignee: Water Generating Systems LLC, Arlington, VA (US)

( * ) Notice: Subject to any disclaimer, the term of this patent is extended or adjusted under 35 U.S.C. 154(b) by 233 days.

(21) Appl. No.: 12/608,464

(22) Filed: Oct. 29, 2009

(65) Prior Publication Data

US 2010/0113845 A1 May 6, 2010

Related U.S. Application Data

(60) Provisional application No. 61/111,645, filed on Nov. 5, 2008.

(51) Int. Cl.
*C07C 9/04* (2006.01)

(52) U.S. Cl. ..... 585/15; 585/899

(58) Field of Classification Search ..... 585/15
See application file for complete search history.

(56) References Cited

U.S. PATENT DOCUMENTS

| | | | | |
|---|---|---|---|---|
| 5,434,330 | A | 7/1995 | Hnatow et al. | |
| 5,964,093 | A * | 10/1999 | Heinemann et al. | 62/45.1 |
| 6,063,972 | A * | 5/2000 | Duncum et al. | 585/15 |
| 6,082,118 | A * | 7/2000 | Endrizzi et al. | 62/46.1 |
| 6,102,986 | A * | 8/2000 | Klug | 95/153 |
| 6,389,820 | B1 * | 5/2002 | Rogers et al. | 62/45.1 |
| 6,602,326 | B2 | 8/2003 | Lee et al. | |
| 6,767,471 | B2 | 7/2004 | Max | |
| 6,797,039 | B2 | 9/2004 | Spencer | |
| 6,855,852 | B1 | 2/2005 | Jackson et al. | |

(Continued)

FOREIGN PATENT DOCUMENTS

JP 10216505 8/1998

(Continued)

OTHER PUBLICATIONS

Ganji, et al. (2007) "Effect of different surfactants on methane hydrate formation rate, stability and storage capacity," Fuel 86, 434-441.

(Continued)

*Primary Examiner* — Ellen McAvoy
(74) *Attorney, Agent, or Firm* — KMF Patent Services, PLLC; Kenneth M. Fagin, Esq.

(57) ABSTRACT

The invention relates to using gas hydrate (clathrate and semi-clathrate) together with a catalytic formulation, including catalyst and anti-foaming agent, to separate specific gases from a gas mixture. In particular, compound hydrate is formed from a mixed gas feedstock to concentrate one or more desired gas species in the hydrate phase and the remainder in the gas phase. The hydrate is then separated from the gas phase and dissociated to produce a gas stream concentrated in the desired species. Additives that both accelerate the growth of hydrate and facilitate dissociation and separation are added to improve the rate of reaction and, at the same time, eliminate hard-to-break foam produced by the catalyst, thereby enhancing the total throughput of the complete process. The addition of some materials can also result in changes in the density of the hydrate product, which can be useful for optimizing the separation of hydrate from unreacted liquid and/or rejected gas.

3 Claims, 2 Drawing Sheets

U.S. PATENT DOCUMENTS

| | | | | |
|---|---|---|---|---|
| 7,947,857 | B2 * | 5/2011 | Nazari et al. | 585/15 |
| 2005/0261529 | A1 * | 11/2005 | Crosby et al. | 585/15 |
| 2007/0106101 | A1 | 5/2007 | Shepherd | |
| 2007/0203374 | A1 * | 8/2007 | Woo et al. | 585/15 |
| 2008/0017078 | A1 | 1/2008 | Bichler et al. | |
| 2008/0022594 | A1 | 1/2008 | Lee et al. | |
| 2008/0072495 | A1 | 3/2008 | Waycuilis | |
| 2008/0167511 | A1 | 7/2008 | Prim | |
| 2009/0035627 | A1 | 2/2009 | Tohidi et al. | |
| 2009/0098028 | A1 * | 4/2009 | Rogers et al. | 422/162 |

FOREIGN PATENT DOCUMENTS

| | | |
|---|---|---|
| WO | WO 2006/131738 | 12/2006 |

OTHER PUBLICATIONS

Ganji, et al. (2007) "Effect of mixed compounds on methane hydrate formation and dissociation rates and storage capacity," Fuel Processing Technology, 99, 891-895.

Lee, et al. (2007) "Methane Hydrate Equilibrium and Formation Kinetics in the Presence of an Anionic Surfactant," J. Phys. Chem. C 2007, 111, 4734-4739.

Rogers, et al. (1999) "Natural Gas Hydrates Storage Project Phase II. Conceptual Design and Economic Study, Final Report," Contract DE-AC26-97FT33203--02, Mississippi State U.

Rovetto, et al. (2006) "Is gas hydrate formation thermodynamically promoted by hydrotrope molecules?," Fluid Phase Equilbria, 247(1-2), 84-89.

Zhong, et al. (2000) "Surfactant effects on gas hydrate formation," Chem. Eng. Sci. 55, 4177-87.

Ahmadloo, et al. (2008) "Gas Separation and Storage Using Semi-Clathrate Hydrates," Proceedings of the 6th International Conference on Gas Hydrates (ICGH 2008).

Kamata, et al. (2004) "Gas Separation Method Using Tetra-n-butyl Ammonium Bromide Semi-Clathrate Hydrate," Japanese J. of Applied Physics, vol. 43, No. 1, 2004, pp. 362-365.

ISR, PCT/US09/63212.

Writ. Op. PCT/US09/63212.

* cited by examiner

| Experiment | Supercooling | System | Rate (mmol $CH_4$/sec) |
|---|---|---|---|
| 1 | 0.63 | 300 ppm SDS | 40 |
| 2 | 0.72 | Uncatalyzed | 2 |

Figure 3

| Subcooling | Methane | Ethane | Propane |
|---|---|---|---|
| 9.0 | 0.04 | 0.089 | 0.10 |
| 5.6 | 0.013 | 0.055 | 0.083 |
| 2.5 | 0.0027 | 0.09 | 0.058 |
| 1.1 | 0.0017 | 0.0081 | 0.036 |

Figure 4

ACCELERATED HYDRATE FORMATION AND DISSOCIATION

CROSS-REFERENCE TO RELATED APPLICATIONS

This application is based on and claims the priority benefit of provisional application 61/111,645 filed Nov. 5, 2008, the contents of which are incorporated by reference.

GOVERNMENTAL SUPPORT AND INTEREST

This invention was made with Governmental Support under Contract Number N00014-05-C-0378 dated Sep. 14, 2005 and issued by the Office of Naval Research (ONR). The Government has certain rights in the invention.

FIELD OF THE INVENTION

In general, the invention relates to the use of compound gas hydrate to separate specific gases from a gas mixture. In particular, additives, such as catalysts and defoaming agents that both reduce the negative effects of the catalyst and allow for rapid, controlled dissociation of the hydrate, are added to accelerate the process rate and thereby permit higher gas throughput.

BACKGROUND OF THE INVENTION

Applications for the industrial synthesizing of clathrate hydrates and semi-clathrates (hereafter referred to as "gas hydrates" or "hydrate," except when differentiation is necessary) include desalination, gas storage, gas transport, and gas separation. Considerable work has been applied to the field of applied physical chemistry of these systems over the past 50 years in order to develop commercial technologies. To our knowledge, none have succeeded in producing a viable innovation for gas separation (although some clathrate hydrate-based processes for transport and desalination on a commercial scale appear close to success). Using gas hydrate systems to separate gases is a recent endeavor that has been mainly focused on extraction of $CO_2$ from combustion exhaust to keep it from emitting into the atmosphere.

In general, clathrate hydrates and semi-clathrates are a class of non-stoichiometric crystalline solids formed from water molecules that are arranged in a series of cages that may contain one or more guest molecules hosted within the cages. For clathrate hydrates, the whole structure is stabilized by dispersion forces between the water "host" molecules and the gas "guests." Semi-clathrates are very similar to clathrate hydrates except one material ("guest material") serves "double-duty" in that it both contributes to the cage structure and resides at least partially within the cage network. This special guest can be ionic in nature, with tetrabutylammonium cations being a classic example.

Hydrate formed from two or more species of molecule (e.g., methane, ethane, propane, carbon dioxide, hydrogen sulfide, nitrogen, amongst others) is referred to by several names: compound hydrate, mixed-gas hydrate, mixed guest hydrate, or binary hydrate. Each hydrate-forming species has a relative preference to enter the hydrate-forming reaction from any gas mixture and each hydrate has a range of cage sizes that can accommodate the guests. Tetrabutylammonium cation semi-clathrates differ from clathrate hydrates in this regard in that they only have one, small cage. They are thus more size selective than clathrate hydrates. Controlled formation of compound hydrate can be used to separate gases based on high and low chemical preference for enclathration or by size rejection ("molecule sieving") in the mixture. Species with a high preference dominate the species in the hydrate while low preference gases are not taken into the hydrate in relation to their percentage of the original mixture and are thus "rejected." Similarly, gases that are too big to fit in the hydrate cages are rejected; again, this is more critical for semi-clathrates than clathrate hydrates.

The controlled artificial production of hydrates is challenging because the natural rate of hydrate formation and dissociation may need acceleration in order for it to be used as the basis of a fully commercial process. Acceleration of the reaction rate of hydrate processes has focused on the role of a certain class of molecules that act as catalysts for hydrate formation and dissociation. Catalysts have been found to increase the rate of hydrate formation and dissociation reactions by orders of magnitude compared to uncatalyzed systems. See Ganji, et al. (2007) "Effect of different surfactants on methane hydrate formation rate, stability and storage capacity," *Fuel* 86, 434-441 ("Ganji 2007). Certain prior art references have focused on the artificial growth aspect of gas hydrate. The use of various additives to increase the growth rate (U.S. Pat. No. 5,434,330, for example) and to promote hydrate growth at lower pressures (U.S. Pat. No. 6,855,852 (discredited by Rovetto, et al. (2006) "Is gas hydrate formation thermodynamically promoted by hydrotrope molecules?," *Fluid Phase Equilbria,* 247(1-2), 84-89)), or by adding additional hydrate-forming "helper" gases (U.S. Pat. Nos. 6,602,326 and 6,797,039) have been considered only for the impact on formation rates and not on the total process rate, or throughput. The impact of these accelerative processes on dissociation does not appear to have been investigated in a systematic manner with respect to the complete processing of gas, for separation or for any other purpose. Not only must hydrate formation be accelerated, but also nothing should be done to inhibit any other stage of the process.

SUMMARY OF THE INVENTION

According to this invention, hydrate is formed by injection of water along with an accelerator (catalyst) in a reactor vessel or vessels and a further material is added that inhibits certain chemical modes of action of the catalyst molecule that slow collection of gas in the dissociation stage. During hydrate formation, desirable gases are preferentially (by chemical affinity or size exclusion) taken into the hydrate while the primary undesirable gas, for instance nitrogen where its separation from a mixture with hydrocarbon gases is desired, is concentrated in the rejected gas mixture. The hydrate and gas are then separated by any of a number of well understood industrial means and the hydrate is dissociated. The effect of the catalyst, which can slow the dissociation reaction, is countered by the presence of another material.

Additives that have been proposed in the prior art to accelerate or otherwise improve hydrate production rates or economics produce foams upon dissociation of the hydrate that more than offset their benefit by retarding or inhibiting the total rate of recovery of product gas. The hydrate formation mechanism and formulation that is disclosed in this work addresses this issue by disclosing an example of a formulation that reduces the impact of the foaming during processing and dissociation. The invention can be applied to hydrate technology processes in general and gas separation, storage, and transport in particular. In this application, gas separation is used as an example of hydrate processes that may be improved through the use of the invention.

We have discovered the following general relationship between the rate of reaction, gas separation efficiency, and relative supersaturation: as relative supersaturation increases, the rate of reaction increases but the gas separation efficiency decreases. It is therefore important to measure the composition change for the particular gas to be separated as a function of supersaturation. There will be a clear performance maximum where the increase in speed due to the raising of the relative supersaturation is offset by the deterioration in gas separation.

BRIEF DESCRIPTION OF THE DRAWINGS

The invention will now be described in greater detail in connection with the drawings, in which:

FIG. 3 is a table showing steady-state, sprayer reaction rates, with no anti-foaming agents being used; and FIG. 4 is a table of normalized reaction rates (frequency rates) for hydrocarbons in a gas mixture reacting in a stirred reactor with 300 ppm accelerator.

DETAILED DESCRIPTION

Figure 1:
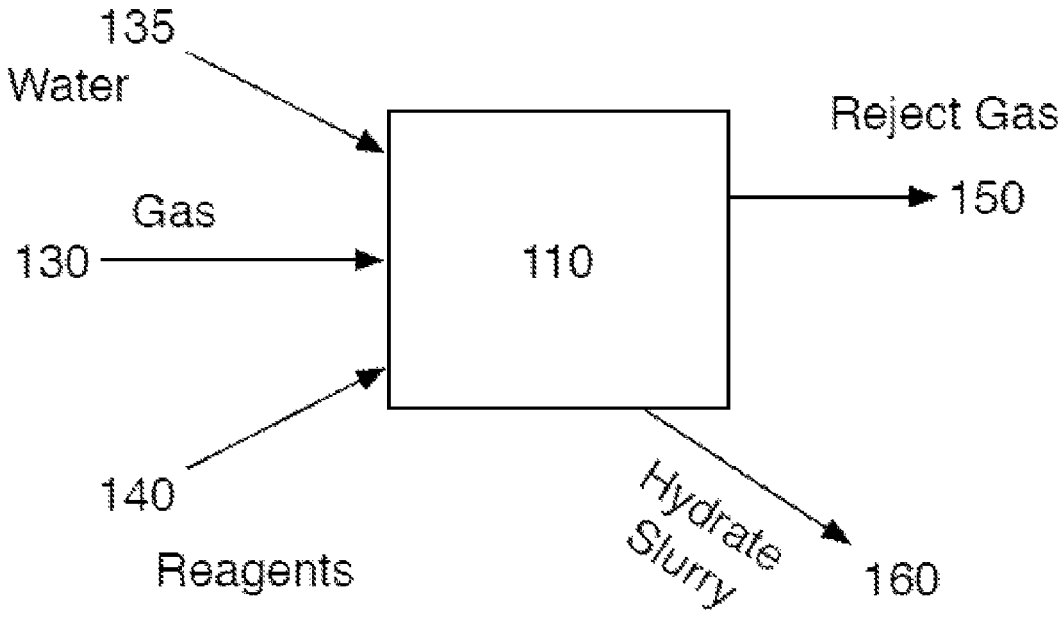
FIG. 1 is a schematic process flow diagram of a single stage hydrate formation reactor.

The invention may be practiced in a vessel or a series of vessels. FIG. 1 shows a schematic process flow diagram of a single vessel 110 for gas hydrate formation. In this case, gas to be processed 130 is injected into the reactor vessel 110, along with water 135. Reagents 140, consisting of catalyst and anti-foaming agent, are injected (with either the water or gas or independently) in order to accelerate the rate of hydrate formation or otherwise condition its growth. Hydrate formation may be accomplished according to the teachings in U.S. Pat. No. 6,767,471, which is incorporated by reference, or in a gaseous atmosphere wherein a fine mist of water is injected under pressure. Hydrate is formed and the reject gas phase 150 (gas not participating in hydrate formation) is removed from the vicinity of the hydrate phase. The hydrate 160 is removed from the vessel. (As is recognized in the art, intentional hydrate formation processes are rarely conducted in a stoichiometric or in a gas-rich manner that consumes all available water; rather, such processes tend to be run water-rich, such that the product hydrate can be conveyed through the apparatus more expeditiously as part of a slurry. Thus, what is depicted schematically as hydrate 160 in the figures would be understood by one of skill in the art as, in actuality, constituting a slurry comprising hydrate (clathrate or semi-clathrate), water, catalyst, and anti-foaming agent, i.e., a mixture of the product clathrate or semi-clathrate and unconsumed reagents).

Figure 2:
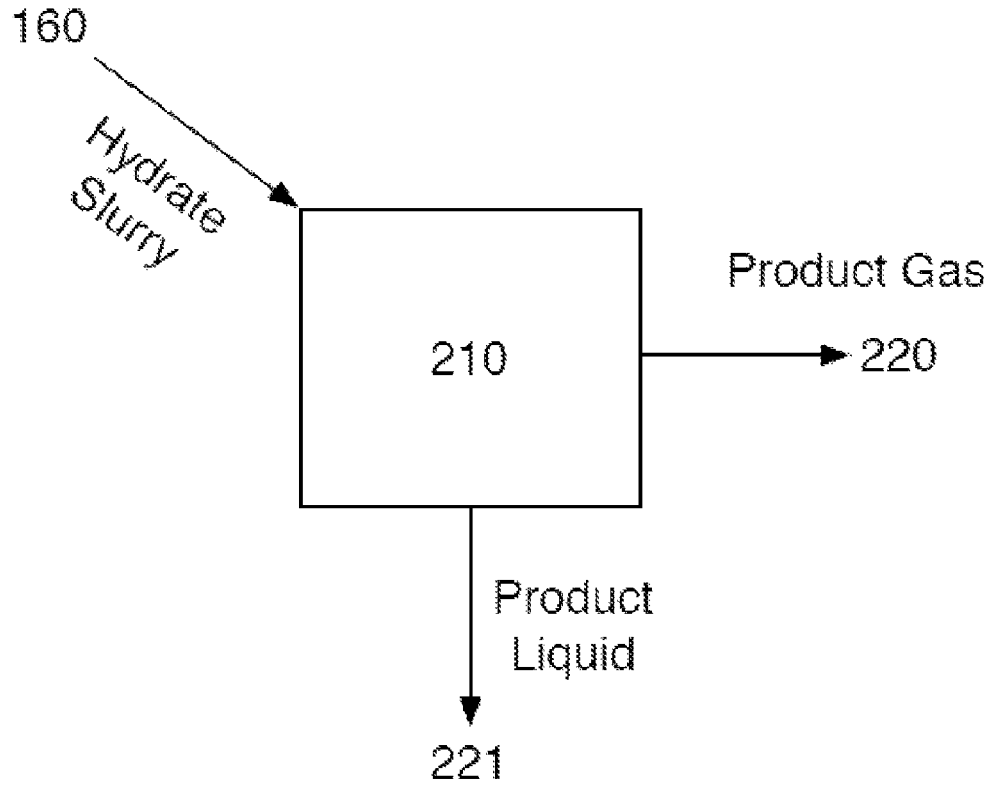
FIG. 2 is a schematic process flow diagram of a single stage hydrate dissociation reactor.

The hydrate components of the slurry are then dissociated in a dissociation vessel 210 (FIG. 2), for the purpose of producing a product gas 220 and a residual or product liquid 221 comprises of water, catalyst, and anti-foaming agent.

A single gas-processing stage may not be sufficient to separate or store all of the gases in the initial reactant mixture. Adding additional stages (not shown) to the process improves the overall performance by increasing the total yield of hydrate relative to the input gas stream. The products of one stage are a "depleted" gas and hydrate slurry. The fate of these two streams depends on the overall goal of the hydrate process. For gas separation, the hydrate may be transported to a lower-pressure stage to re-equilibrate to a different composition, where the concentration of preferred formers in the hydrate is increased, and the gas may be transported to a higher-pressure stage to capture more of the preferred formers in the hydrate. The general effect is that hydrate moves towards the lower pressure side of the system while gas travels toward the high-pressure outlet. As the hydrate moves toward lower pressure, it becomes enriched in the preferred formers. As the gas travels toward the high-pressure outlet, it becomes depleted in preferred formers.

Natural hydrate formation normally takes place slowly or with very low rate of conversion from the available hydrate-forming gases and water. However, certain additives can be used to alter the pressure requirement for hydrate formation and allow the reaction to proceed at lower pressures. The use of certain anionic surfactants, such as sodium dodecyl sulfate (SDS), had been shown to increase formation (see Zhong et al. (2000) "Surfactant effects on gas hydrate formation," *Chem. Eng. Sci.* 55, 4177-87) and dissociation rate dramatically (see Ganji 2007). However, the presence of the catalyst initially was found by us to promote the formation of a dense, heavy foam during dissociation. The foam makes processing of the products extremely difficult and more than offsets the increase in formation reaction rate afforded by the catalyst. We believe that prior art has overlooked the overall impact of the surfactant on the practicability of a process based on this technology. The formation of the foam results in an unworkable process. Most co-agents that participate in hydrate (clathrate or semi-clathrate) formation, including but not restricted to SDS, hydrotropes, and tetraalkylammonium halides, produce foam. Other agents, such as tetrabutylammonium bromide, produce a foam that breaks relatively quickly compared to the other catalysts, but this molecule also forms semi-clathrates, which may be beneficial or harmful to the separation attempted. Hydrate dissociation in the presence of the catalyst results in the evolution of very small bubbles and inefficient gas recovery rates in the dissociation stage, which has the effect of offsetting their beneficial aspects for hydrate growth.

Although the use of these compounds as catalysts is widely believed to form foam that would make application of the technology impossible at industrially significant scales, it has been demonstrated by us in our laboratory that the addition of a certain class of anti-foaming agent preserves the activity of the catalyst while greatly reducing the impact of the foam. The combination of a suitable catalyst and a suitable and compatible anti-foaming agent enhances the rate of hydrate formation and its controlled dissociation and will allow a gas throughput flow rate sufficient for a commercial process.

In order to develop a workable process for hydrate-based gas separation, we carried out experiments in both accelerating the rate of the hydrate formation reaction and in foam reduction during the dissociation phase. Achieving the highest rates possible for both controlled formation and dissociation is critical to the rate at which gas being treated can be passed through the system and adequately separated. We have applied our results to the field of industrial natural gas separation, particularly nitrogen rejection and ethane and propane recovery. We constructed and built a reactor to test the technology and verify that it 1) operates at an enhanced rate because of the combination of surfactant catalyst and anti-foaming agent, 2) separates hydrocarbon gases from nitrogen, and 3) can concentrate ethane and propane from a mixture of methane, ethane, and propane.

One of the common catalysts, SDS, increases the rate of hydrate formation. This has been measured by Lee et al. (see Lee, et al. (2007) "Methane Hydrate Equilibrium and Formation Kinetics in the Presence of an Anionic Surfactant," *J. Phys. Chem. C* 2007, 111, 4734-4739) and Ganji et al. (see Ganji 2007) to be 10-20 times faster than uncatalyzed reactions, but their experiments were carried out only on volumes of less than 1 liter. Because crystallization processes have characteristics that are often related to the size of the reactor vessel, we have carried out experiments in vessels of 15+ liters (reactive liquid formulation volume; the volume of gas to be processed can be varied from nearly 0 to 20 liters) equipped with cooling coils. The reactive solution was circulated through a pump and reintroduced to the vessel either via a sprayer or through a submerged jet. The reactor was filled with a catalytic solution (Experiment 1, FIG. 3) or water (Experiment 2, FIG. 3). The system was pressurized with pure ethane gas and then cooled into the hydrate stability field. Before this step, a control reaction was conducted without mixing or catalyst. This control experiment produced a very small amount of hydrate at the gas/liquid interface; however, the amount of gas consumed was too little to be detected (<1 psi change at constant temperature and volume over two days). Other control experiments included 1) mixing without catalyst (reaction rates about 1/10 to 1/50 of the similarly catalyzed reaction rates) and 2) catalyst with no mixing (80%+ conversion of water over 24 hours).

In general, in the case of the catalyzed, mixed systems experiments that included both catalysts and anti-foaming agents, there was a brief period of rapid hydrate formation immediately following nucleation, which may itself have been enhanced. The reaction then slowed and a steady-state reaction rate was measured. This rate was about 20 times faster for the solution catalyzed with 300 ppm SDS than the uncatalyzed solution at about the same subcooling (FIG. 3). We have tried both 300 ppm and 1200 ppm SDS in our reactors. We have found very reproducible results at 300 ppm, but very erratic results at 1200 ppm. We have thus rejected using higher concentrations of SDS because stability and reproducibility is a primary concern for industrial processes. This is beneficial because it sets a low maximum amount required for our process. We observed that, to the extent the rate of hydrate formation was enhanced, both of these experiments behaved in a similar manner to that which has been reported in the literature with much smaller vessels and despite the presence of anti-foaming agent. We thus have discovered that, by providing the anti-foaming agent, the catalytic effect can be extended to much-larger vessels despite the presence of anti-foaming agent and despite the scale-up effects referenced above.

We added 100-500 ppm doses of commercially available anti-foaming agent (for example, Dow Corning Antifoam 1920). We found that it acted as neither an inhibitor nor a co-catalyst. It reduced the impact of foam formation during formation and dissociation of the hydrate. The short-lived foam produced during formation has been eliminated in our experiments, and the long-lived, fine foam produced during dissociation breaks rapidly. This allows for the high rate of reaction made available by the catalysts to be applied to a complete industrial process.

We also measured the effect of subcooling, a measure of the driving force of crystallization, on reaction rate of hydrocarbons from a mixed gas phase being consumed into gas hydrate (FIG. 4). We found that by driving the temperatures lower than the stability temperature at a given pressure and gas composition, some driving force acceleration of the hydrate-forming reaction could be gained. We found that with increasing subcooling, the rate of reaction increases, but that the degree of gas separation decreases as the less-preferred formers' rates increase faster than the more-preferred formers' rates. We believe that this relationship has not been recorded in the literature or presented publically prior to this disclosure.

Therefore, we conclude that for optimal gas separation based on degree of hydrate-forming preference of each gas in this invention, conditions in the hydrate formation and reformation stages should be maintained with minimum sub-cooling. This is actually a beneficial determination for operating conditions because it minimizes refrigeration requirements and costs.

Using accelerated and conditioned hydrate gas separation, for instance to remove nitrogen from hydrocarbon gas, would appear to be very competitive with existing membrane and cryogenic processes from energy, temperature, and pressure standpoints. First, hydrate forms from liquid water at temperatures between 0 and 20° C., which means that major energy consumption for refrigeration and heating are not necessary. Second, hydrate formation produces product gas at a higher pressure than other techniques, which can result in significant energy savings. Third, hydrate processes do not require pre-drying of all of the inlet gas, only post drying of the hydrocarbon-rich product, and the drying specification is much higher than the 77 K dew point for cryogenic operations. Fourth, the hydrate system can be used to produce some liquefied natural gas products, especially propane and isobutane. Fifth, the hydrate process has low complexity when compared to a cryogenic gas separation installation. Sixth, the hydrate process can be applied over a wide range of gas flow rates and can be operated in either batch, semi-batch, or continuous modes.

By type, surfactants and hydrotropes that can be used as catalysts include the following:

Anionic surfactants including: sodium dodecyl sulfate, sodium butyl sulfate, sodium ocatdecyl sulfate, linear alkyl benzene sulfonate;

Cationic surfactants including: cetyl timethyl ammonium bromide;

Neutral surfactants including: ethoxylated nonylphenol;

Hydrotropes including: sodium triflate; and

"Promoters" including: hydrogen sulfide, tetrahydro furan, cyclopentane, and cyclopropane. (These are actually hydrate-formers.)

It will be apparent that various modifications to and departures from the above-described methodologies will occur to those having skill in the art. What is desired to be protected by Letters Patent is set forth in the following claims.

We claim:

1. A method, comprising:

forming a mixture of water and clathrate-forming or semi-clathrate-forming material and subjecting the mixture to pressure and temperature conditions suitable for clathrate or semi-clathrate to form such that clathrate or semi-clathrate does form, wherein a catalyst (clathrate or semi-clathrate accelerator) and a separate anti-foaming agent are included in the mixture; and subsequently causing or allowing the clathrate or semi-clathrate to dissociate.

2. The method of claim 1, wherein said clathrate-forming or semi-clathrate-forming material comprises a mixture of different species of gas having different affinities for forming clathrate or semi-clathrate.

3. The method of claim 2, wherein the method is used to separate at least some of the different species of gas from the mixture of different species of gas.

* * * * *